US006299833B1

(12) United States Patent
Cristinacce et al.

(10) Patent No.: US 6,299,833 B1
(45) Date of Patent: Oct. 9, 2001

(54) STEEL COMPOSITION

(75) Inventors: Michael Cristinacce; Katrina Sarah Blackie; Philip Edward Reynolds, all of Rotherham; Robert Murray Gardner, Bromsgrove, all of (GB)

(73) Assignees: Corus UK Limited; United Engineering Forgings Limited, both of (GB)

( * ) Notice: Subject to any disclaimer, the term of this patent is extended or adjusted under 35 U.S.C. 154(b) by 0 days.

(21) Appl. No.: 09/147,226

(22) PCT Filed: May 20, 1998

(86) PCT No.: PCT/GB98/01460

§ 371 Date: May 24, 2000

§ 102(e) Date: May 24, 2000

(87) PCT Pub. No.: WO99/46420

PCT Pub. Date: Sep. 16, 1999

(30) Foreign Application Priority Data

Mar. 10, 1998 (GB) ..... 9804934

(51) Int. Cl.[7] ..... C22C 38/60; C22C 38/12
(52) U.S. Cl. ..... 420/87; 420/84
(58) Field of Search ..... 420/84, 87

(56) References Cited

U.S. PATENT DOCUMENTS 5,769,970 * 6/1998 Robelet et al. ..... 420/87

* cited by examiner

*Primary Examiner*—Deborah Yee
(74) *Attorney, Agent, or Firm*—Blank Rome Comisky & McCauley, LLP

(57) ABSTRACT

The application describes a steel composition consisting essentially of

Carbon 0.50–0.70 weight %
Silicon up to 0.40 weight %
Manganese 0.55–1.00 weight %
Phosphorus 0.030–0.070 weight %
Sulphur 0.055 to 0.110 weight %
Chromium up to 0.50 weight %
Molybdenum up to 0.10 weight %
Nickel up to 0.5 weight %
Copper up to 0.50 weight %
Aluminium up to 0.050 weight %
Optionally, Vanadium sufficient to maintain yield strength
Nitrogen up to 0.030 weight %, together with, optionally, lead up to 0.4 weight %, and unavoidable impurities, the balance being iron. This steel composition exhibits mechanical properties which are suitable for use in connecting rods but which provide both good fracture splitting performance and good machinability when compared to C70S6 alloys. The application also refers to a fracture splittable steel including between 0.50 to 0.70 wt % C, 0.55 to 1.00 wt % Mn, 0.030 to 0.070 wt % P and 0.055 to 0.110 wt % S, and with an elongation of 25% or less, a reduction of area below 25%, and a $V_{20}$ machinability (m/min) satisfying the equation:

$$V_{20} \geqq 80-0.2H$$

where H is the HV30 hardness of the steel.

20 Claims, 6 Drawing Sheets x200 x200 x500 x500 x200 x200

STEEL COMPOSITION

This application is a PCT/GB98/01460 filed May 20, 1998.

BACKGROUND OF THE INVENTION

1. Field of the Invention

The present invention relates to a steel composition useful in the manufacture of steel parts. More especially, the invention concerns an improved composition for fracture splitting forged steel assemblies, such as for use in connecting rods in internal combustion engines.

2. Description of Related Art

Conventional forged steel connecting rods are usually produced as a one piece forging. During subsequent machining processes the "big end" is split by a machining process such as sawing, broaching, etc. This results in a connecting rod and "cap" which after further drilling and machining operations, can be bolted together to enable the connecting rod to be mated with the crankshaft and bearing shells on assembly of the engine.

Splitting the connecting rod by a fracturing process instead of cutting enables the bolt holes to be drilled prior to splitting, enabling fewer operations to be used. Conventional splitting by machining also requires several further machining operations to be carried out to ensure that the connecting rod and cap can subsequently be relocated precisely on assembly. The use of fracture splitting produces surfaces with a unique topography, which can be relocated precisely on refitting without need for machining.

The overall benefit of fracture splitting therefore is to reduce material loss and to eliminate several machining operations during connecting rod manufacture. Reducing the machining operations results in savings of energy, time, labour, tooling investment and floor space.

The predominant connecting rod materials used in internal combustion engines are wrought steel forgings, cast iron and sintered powder forgings. Steel forgings, whether heat treated or directly air cooled after forging, exhibit higher ductility than cast iron or sintered powder forgings. These properties can give rise to disadvantages when forged steel connecting rods are fracture split, compared to cast iron or sintered powder forgings. The higher ductility results in more deformation of the connecting rod and cap during fracture splitting which can result in deformation of the bolt holes, imperfect relocation of the fracture surfaces and a need to remove more material in the final bore machining process.

Despite this, there are strong advantages in using wrought steel due to its improved mechanical properties as compared with cast iron and lower unit cost as compared with sintered powder forging.

The problem inherent in fracture splitting is to obtain a fracture surface which can be mated successfully, without compromising the overall mechanical integrity of the connecting rod. If the material is not brittle, it will be impossible to mate the resultant surfaces. If the material is insufficiently brittle, then some plastic deformation will result leading to a departure from circularity of the bearing assembly.

This problem has been addressed before, and a summary of several known means of overcoming this difficulty is given in EP 167320. This states that embrittlement of material in or around the separating planes may be provided for by material selection, by heat treatment such as hardening of various types, or by cryogenic cooling of the material to reduce its temperature to below the embrittlement point. Other methods of embrittlement proposed in the prior art include the local generation of hydrogen gas by application of acid or electrochemical means, which results in local hydrogen embrittlement of the steel. Finally, U.S. Pat. No. 5,135,587 proposes selection of a pearlitic steel with a grain size grade between 3 and 8 according to ASTM specification E112-8, which is obtain ed by a steel containing 0.60 to 0.75% carbon. This steel is used commercially for fracture split connecting rods in the form of C70 steel, but several users report machinability difficulties. It is usual to provide notches in the forging to act as fracture initiation sites. These can be formed by conventional or laser machining.

Cryogenic methods of achieving temporary embrittlement generally involve dipping the part in liquid nitrogen. This is a very expensive operation and there are practical difficulties in carrying it out in the normal machining environment.

Methods involving acid or electrolytic generation of hydrogen have obvious practical difficulties and dangers and give rise to effluent disposal expenses.

The steels which are commonly employed for fracture split connecting rods have a carbon content around 0.70% and are based upon the composition disclosed in U.S. Pat. No. 5,135,587. Further details can be found in M A Olaniran and C A Stickels: "Separation of Forged Steel Connecting Rods and Caps by Fracture Splitting"; SAE Technical Paper 930033, 1993. In Europe, steels of this type are normally referred to by the "Kurznamen" Code as C70S6. The mechanical properties of connecting rods in this grade are developed by controlled air cooling after forging, eliminating the need for heat treatment. The main disadvantage of the current C70S6 grade is the relatively poor machinability compared to other air cooled steels which normally have a lower carbon content. This is attributable to the higher content of the more abrasive carbides resulting from a fully pearlitic microstructure. This microstructure is necessary to facilitate fracture splitting.

C70S6 usually have a composition generally as follows:

| | |
|---|---|
| C | 0.65 to 0.75 wt % |
| Si | 0.15 to 0.40 wt % |
| Mn | 0.4 to 0.60 wt % |
| P | up to 0.045 wt % |
| S | 0.050 to 0.080 wt % |
| Cr | up to 0.20 wt % |
| Mo | up to 0.06 wt % |
| Ni | up to 0.08 wt % |
| Cu | up to 0.40 wt % |
| Sn | up to 0.04 wt % |
| Al | up to 0.010 wt % |
| V | 0.030 to 0.060 wt % |
| N | up to 0.016 wt % |

This is, however, a summary. Individual steels employ specific compositions lying within narrower or wider bands.

This can result in tensile strengths of 850 to 1000 N/mm$^2$ with 0.2% proof strengths over 550 N/mm$^2$. Typical elongation and reduction of area values are 8–12% and 20–30% respectively. Impact energies are typically 10 J with a 2 mm V notch. Hardness generally lies in the 220–310 HB range.

One measure of machinability is $V_{20}$, the cutting speed at which a 20 minute tool life is achieved on an unlubricated single-point turning test with high speed tools. The higher the $V_{20}$ value, the better the machinability. A plot of $V_{20}$ results against hardness is given in FIG. 1 for typical microalloyed steels and two examples of C70S6 grade. It can be seen that the C70S6 gives a poor machinability, at the bottom of the microalloy steel "scatter band".

SUMMARY OF THE INVENTION

The present invention therefore provides a fracture splittable steel composition consisting essentially of Carbon 0.50–0.70 weight %

Silicon up to 0.40 weight %

Manganese 0.55–1.00 weight %

Phosphorus 0.030–0.070 weight %

Sulphur 0.055 to 0.110 weight %

Chromium up to 0.50 weight %

Molybdenum up to 0.10 weight %

Nickel up to 0.5 weight %

Copper up to 0.50 weight %

Aluminium up to 0.050 weight %

Optionally, Vanadium sufficient to maintain yield strength

Nitrogen up to 0.030 weight %, together with, optionally, lead up to 0.4 weight %, and unavoidable impurities, the balance being iron.

As will be apparent from the following description, this steel composition exhibits mechanical properties which are suitable for use in connecting rods but which provide both good fracture splitting performance and good machinability when compared to C70S6 alloys.

The present invention also relates to the use of steel composition as defined above in the manufacture of a connecting rod for an internal combustion engine.

It also relates to a connecting rod per se for an internal combustion engine, the connecting rod being manufactured of a steel as set out above.

It is preferred if the elongation of the steel is 19% or less. It is also preferred if the steel has a brinell hardness of 200 or greater. Very high hardness does adversely affect machinability, so a maximum of 350 HB is preferred. A suitable working range is 220 to 302 HB.

The carbon content of the steel is preferably within 0.57 to 0.67%, in order to narrow the physical properties of the steel. A particularly advantageous range is 0.60 to 0.65%.

The silicon content of the steel can usefully be maintained above 0. 10 weight %; and preferably below 0.35%. It is more preferably between 0.15 and 0.30 weight %.

Manganese additions will ideally be between 0.70 and 0.80 weight %, but good steels can still be obtained between 0.60 and 0.90%.

To assist the machinability of the steel further, the sulphur content should be at least 0.070 weight %, and a range of 0.080 to 0.100 weight % is preferred.

To assist the fracture splittability of the steel, the P content should be at least 0.030 wt %, and a range of 0.035 to 0.050 wt % is particularly preferred.

Other constituents can usefully be limited as follows:

Molybdenum preferably 0.05 weight % maximum;

Nickel preferably 0.25% maximum;

Copper preferably 0.30%, more preferably 0.25% maximum;

Aluminium 0.025 weight % max;

Chromium 0.10 to 0.20 weight %;

Nitrogen 0.025 weight % max, particularly preferred 0.020 weight %.

Vanadium is known to assist the yield and proof strength of the steel. A suitable range is up to 0.15 weight %. It is preferably above 0.040 weight %.

The composition could of course include a variety of other alloying elements such as those commonly encountered in metallurgical applications, provided that the levels present do not substantially affect the fracture splitting performance of the steel.

The present invention also provides a fracture splittable steel including between 0.50 to 0.70 wt % C, 0.55 to 1.00 wt % Mn, 0.030 to 0.070 wt % P and 0.055 to 0.110 wt % S, and with an elongation of 25% or less, a reduction of area below 25%, and a $V_{20}$ machinability (m/min) satisfying the equation $V_{20} \geqq 80-0.2$ H, where H is the HV30 hardness of the steel.

BRIEF DESCRIPTION OF THE FIGURES OF DRAWINGS

Examples illustrating the invention will now be described by way example, with reference to the accompanying figures, in which.

Figure 6A:
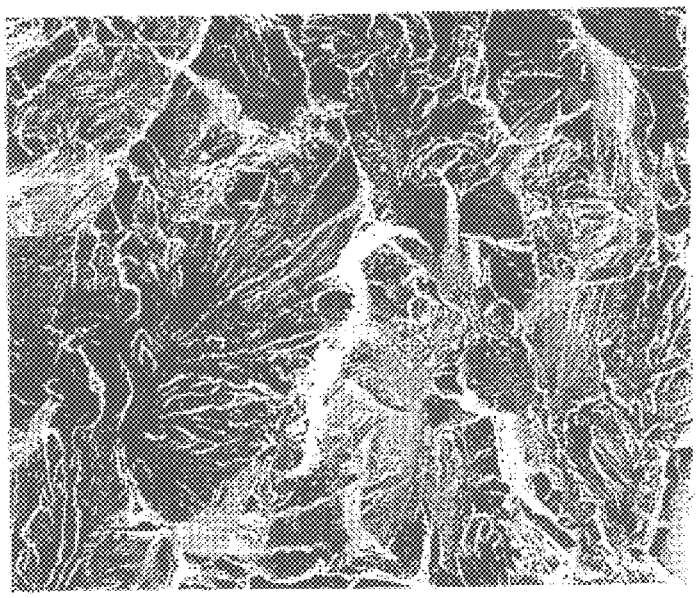
Figure 6B:
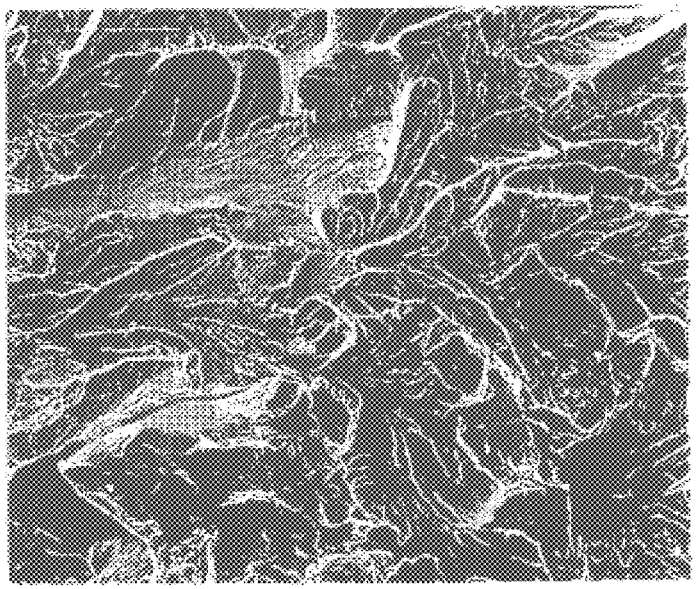
Figure 7A:
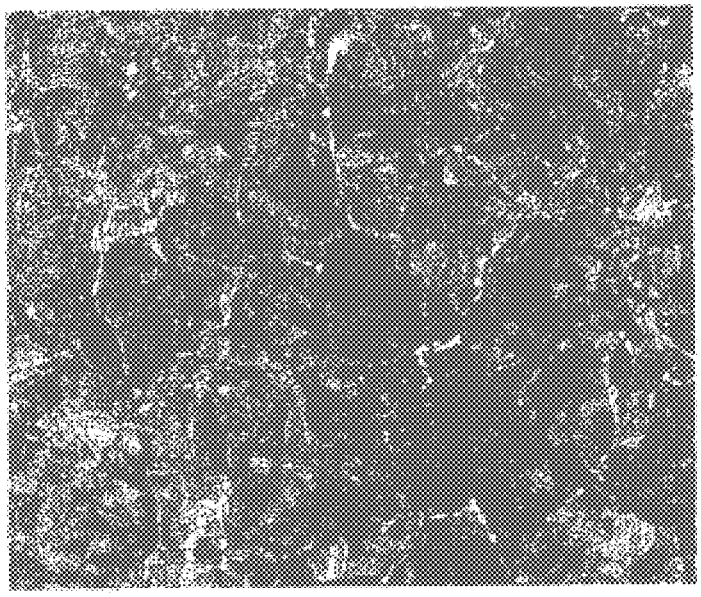
Figure 7B:
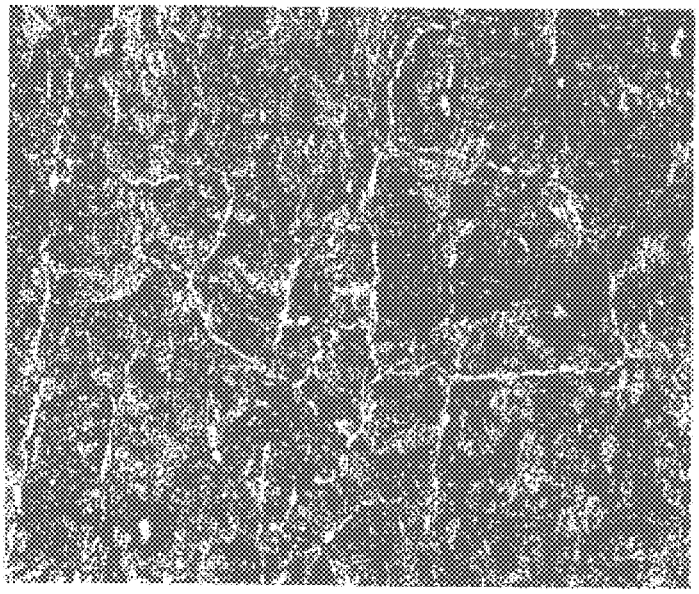

FIGS. 6*a* and 6*b* show SEM micrographs of a fracture split C70S6 steel con rod, and con rod of steel according to the present invention, illustrating fracture surfaces; and FIGS. 7*a* and 7*b* show optical micrographs of C70S6 steel and steel according to the present invention, illustrating the microstructures thereof.

DETAILED DESCRIPTION OF THE PREFERRED EMBODIMENT

The ways in which we believe the machinability of C70S6 could be improved are by addition of sulphur and lead.

The existing C70S6 grade has an enhanced sulphur content 0.060/ 0.070% compared to a typical level of 0.040% maximum in normal engineering steels. The objective of this enhanced sulphur content is to improve machinability. Despite this increased sulphur content there is however still a need to improve on the machinability of the C70S6 grade.

There are several ways in which machinability can be improved. The two most common means are by adding more sulphur or by adding lead. The addition of lead to a level of up to 0.40% would give a significant improvement in machinability but may encounter some resistance in the automotive market due to perceived environmental concerns. The addition of more sulphur to the existing analysis range is restricted by the low manganese (Mn) content which is employed. For example, the existing manganese range is 0.45/0.55%, whilst the existing sulphur range is 0.060 /0.070%. The Mn:S ratio is very important in ensuring that steel can be cast and rolled without cracking, as a result of "hot shortness". One of the roles of manganese in steel is to combine with sulphur to form manganese sulphide (MnS), to avoid the presence of low melting point iron sulphides. The iron sulphides are liquid during solidification, rolling and forging and lead to "hot shortness" which prevents these processes from being successfully applied. In order to ensure freedom from hot shortness, a Mn:S ratio of 6:1 minimum is needed. The extremes of the existing Mn and S ranges above are just within the 6:1 minimum range and hence there is no scope for an increase in sulphur content at the current C70S6 manganese content.

Increasing the manganese content in isolation will cause excess carbide to be precipitated at the microstructural grain boundaries and lead to a decrease in machinabiity. The ideal microstructure for fracture splitting is pearlitic but with an absence of grain boundary carbide to prevent a deterioration in machinability. This can be achieved by lowering the carbon content as the manganese is raised.

This was initially demonstrated on 15 mm diameter test bars, air cooled from 1150° C. to simulate the controlled cooling of connecting rods from forging:

Two casts were used as follows:

| GRADE | C | Si | Mn | P | S | Cr | V |
|---|---|---|---|---|---|---|---|
| 64C, 83Mn | 0.64 | 0.26 | 0.83 | 0.005 | 0.020 | 0.15 | 0.003 |
| C70S6 | 0.71 | 0.19 | 0.51 | 0.006 | 0.066 | 0.11 | 0.094 |

The mechanical properties were as follows:

| GRADE | UTS ($N/mm^2$) | 0.2% PS ($N/mm^2$) | EI (%) | R/A (%) | CHARPY 3mmU Notch (J) | CHARPY 2mmV Notch (J) |
|---|---|---|---|---|---|---|
| 64C, 83Mn | 1033 | 619 | 11.8 | 18.3 | 9, 10, 10 | 6, 8, 7 |
| C70S6 | 1026 | 594 | 13.6 | 23.5 | 14, 11, 16 | 8, 8, 8 |

Figure 1:
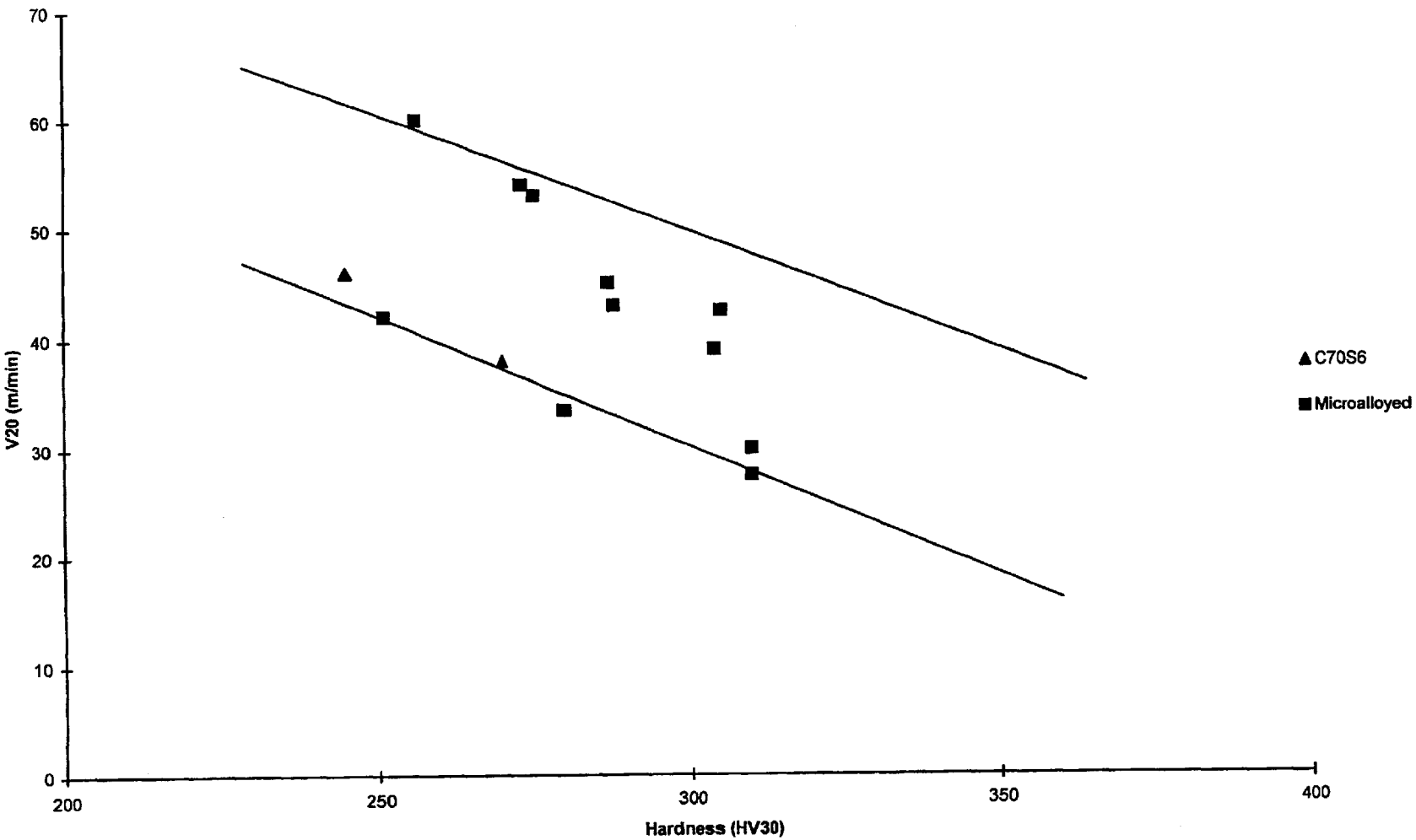
FIG. 1 illustrates the variation in machinability of typical microalloyed steels.
Figure 2:
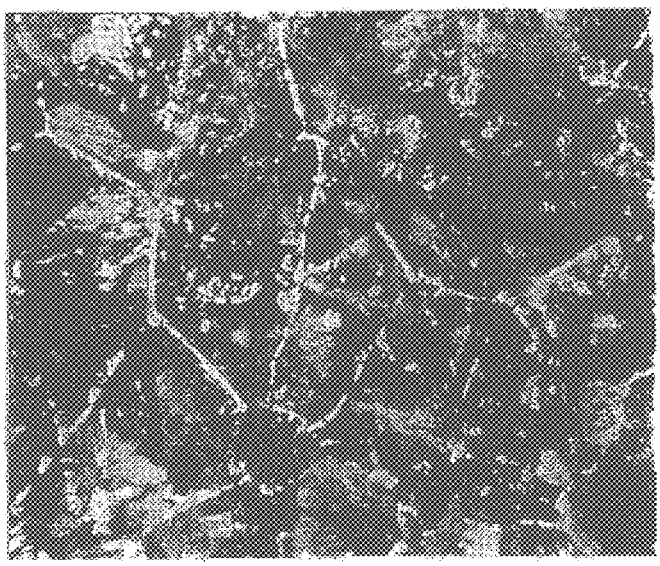
FIG. 2 shows a typical microstructure of a 0.64% C, 0.83% Mn steel.
Figure 3:
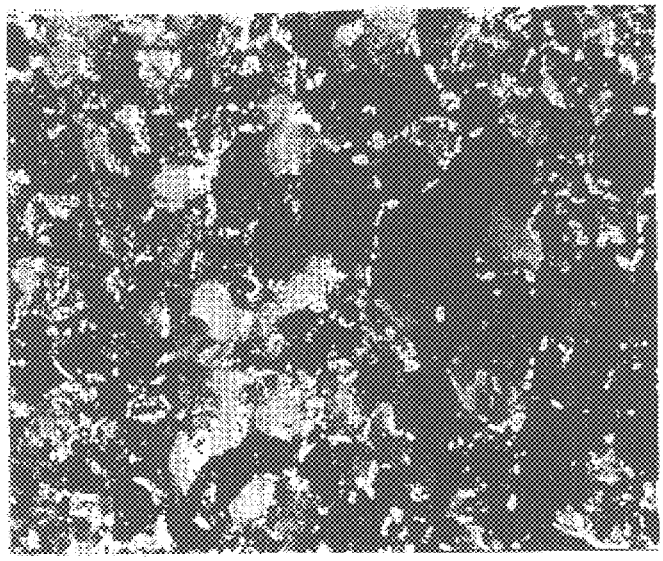
FIG. 3 shows a typical microstructure of a C70S6 steel.

The microstructures given in FIGS. 2 and 3, show that both steels had microstructures which were pearlitic with a small amount of grain boundary ferrite.

The embrittling effect of phosphorus (P) in steel is well known, as mentioned in (for example) F B Pickering: "High Strength, Low Alloy Steels—A Decade of Progress"; Microalloying'75, 1–3 Oct. 1975; Washington D.C. pp6–7. Normally a maximum limit of 0.035, 0.040 or 0.050% is given in steel specifications. Phosphorus also has a "hot shortness" effect due to the formation of low melting point phosphorus-rich phases.

The apparently beneficial effect of phosphorus was demonstrated experimentally on air cooled connecting rods which were fracture split on a prototype splitting device:

The three casts used were as follows:

| GRADE | C | Si | Mn | P | S | Cr | V |
|---|---|---|---|---|---|---|---|
| C70S6 | 0.72 | 0.23 | 0.49 | 0.009 | 0.062 | 0.15 | 0.04 |
| 52C, 87Mn | 0.52 | 0.21 | 0.87 | 0.019 | 0.084 | 0.18 | <0.005 |
| 080A47mod | 0.49 | 0.29 | 0.79 | 0.038 | 0.071 | 0.21 | <0.005 |

After fracture splitting, the cap and connecting rod body were remated and bolted together and the elongation of the big end bore was measured. The average elongation values of the big end bore after fracture splitting were as follows:

| GRADE | ELONGATION (mm) |
|---|---|
| C70S6 | 0.139 |
| 52C, 87Mn | 0.572 |
| 080A47mod | 0.287 |

The reason for the improved fracture splittability of the 080A47 steel compared to the 52C,87Mn grade was not readily explained by the mechanical properties or the microstructure which had a higher ferrite content. It was concluded that the higher phosphorus content was the reason for the improvement.

The above results allow the major factors to be identified. Based on these, a number of experimental melts of 500 kg weight were made by induction melting, casting and forging to 50 mm diameter bar. These bars were turned to 44 mm diameter, reheated and forged into connecting rods and control air cooled to room temperature. For comparison purposes, an as-production cast of C70S6 grade was included in the trial. The connecting rods were machined and bored and after notching by laser, were fracture split on a device typical of those used on a commercial production basis.

Full measurements of production conditions, mechanical properties and bore diameters before and after the splitting process were carried out.

The results are as follows:

TABLE 3

| | COMPOSITIONS OF EXPERIMENTAL MATERIALS (WT %) | | | | | | | | | | | |
|---|---|---|---|---|---|---|---|---|---|---|---|---|
| | C | Si | Mn | P | S | Cr | Mo | Ni | Cu | Al | V | N |
| BASE | 0.62 | 0.25 | 0.80 | 0.011 | 0.067 | 0.17 | 0.03 | 0.17 | 0.16 | 0.014 | 0.04 | 0.013 |
| 0.62% C + P | 0.62 | 0.25 | 0.71 | 0.046 | 0.064 | 0.18 | 0.03 | 0.17 | 0.16 | 0.012 | 0.04 | 0.012 |
| 0.64% C + P | 0.64 | 0.31 | 0.70 | 0.045 | 0.062 | 0.19 | 0.03 | 0.18 | 0.16 | 0.012 | 0.04 | 0.012 |
| 0.59% C + P + S | 0.59 | 0.13 | 0.71 | 0.046 | 0.098 | 0.16 | 0.03 | 0.17 | 0.16 | 0.010 | 0.04 | 0.013 |
| 0.63% C + P + S | 0.63 | 0.23 | 0.78 | 0.045 | 0.100 | 0.17 | 0.03 | 0.17 | 0.16 | 0.010 | 0.04 | 0.012 |
| C70S6 | 0.70 | 0.16 | 0.53 | 0.009 | 0.066 | 0.14 | 0.02 | 0.009 | 0.12 | 0.009 | 0.045 | 0.010 |

TABLE 4

| | UTS ($N/mm^2$) | 0.2% PROOF STRESS ($N/mm^2$) | ELONGATION (%) | ROA (%) | HB |
|---|---|---|---|---|---|
| BASE | 1014 | 643 | 19 | 23 | 269 |
| 0.62% C + P | 1041 | 668 | 12 | 22 | 285 |
| 0.64% C + P | 1054 | 701 | 15 | 26 | 302 |
| 0.59% C + P + S | 981 | 666 | 11 | 21 | 277 |
| 0.63% C + P + S | 1042 | 602 | 16 | 24 | 269 |
| C70S6 | 1037 | 675 | 20 | 20 | 285 |

TABLE 5

| | No. OF TESTS | AVE. OUT OF ROUNDNESS (μm) | STANDARD DEVIATION (μm) |
|---|---|---|---|
| BASE | 14 | 72.3 | 19.5 |
| 0.62% C + P | 17 | 40.4 | 13.4 |
| 0.64% C + P | 14 | 45.0 | 18.7 |
| 0.59% C + P + S | 8 | 51.0 | 9.8 |
| 0.63% C + P + S | 14 | 42.2 | 9.0 |
| C70S6 | 14 | 47.9 | 8.3 |

TABLE 6

| | No. OF TESTS | AVE. OUT OF ROUNDNESS (μm) | STANDARD DEVIATION (μm) |
|---|---|---|---|
| BASE | 14 | 72.3 | 19.5 |
| 0.6% C + P | 31 | 42.5 | 16.2 |
| 0.6% C + P + S | 22 | 45.4 | 10.2 |
| C70S6 | 14 | 47.9 | 8.3 |

It can be seen from table 4 that all the experimental steels gave mechanical properties equivalent to the C70S6 grade.

The out of roundness results, measured in the big end bore of the connecting rods after remating, are given in table 5. It can be seen that the 'base' experimental steel, ie: with lower carbon and high manganese, but without phosphorus and sulphur additions, gave greater out of roundness values than the C70S6 comparison material. The variants with phosphorus and with phosphorus and sulphur additions gave results similar to the C70S6 material.

Figure 4:
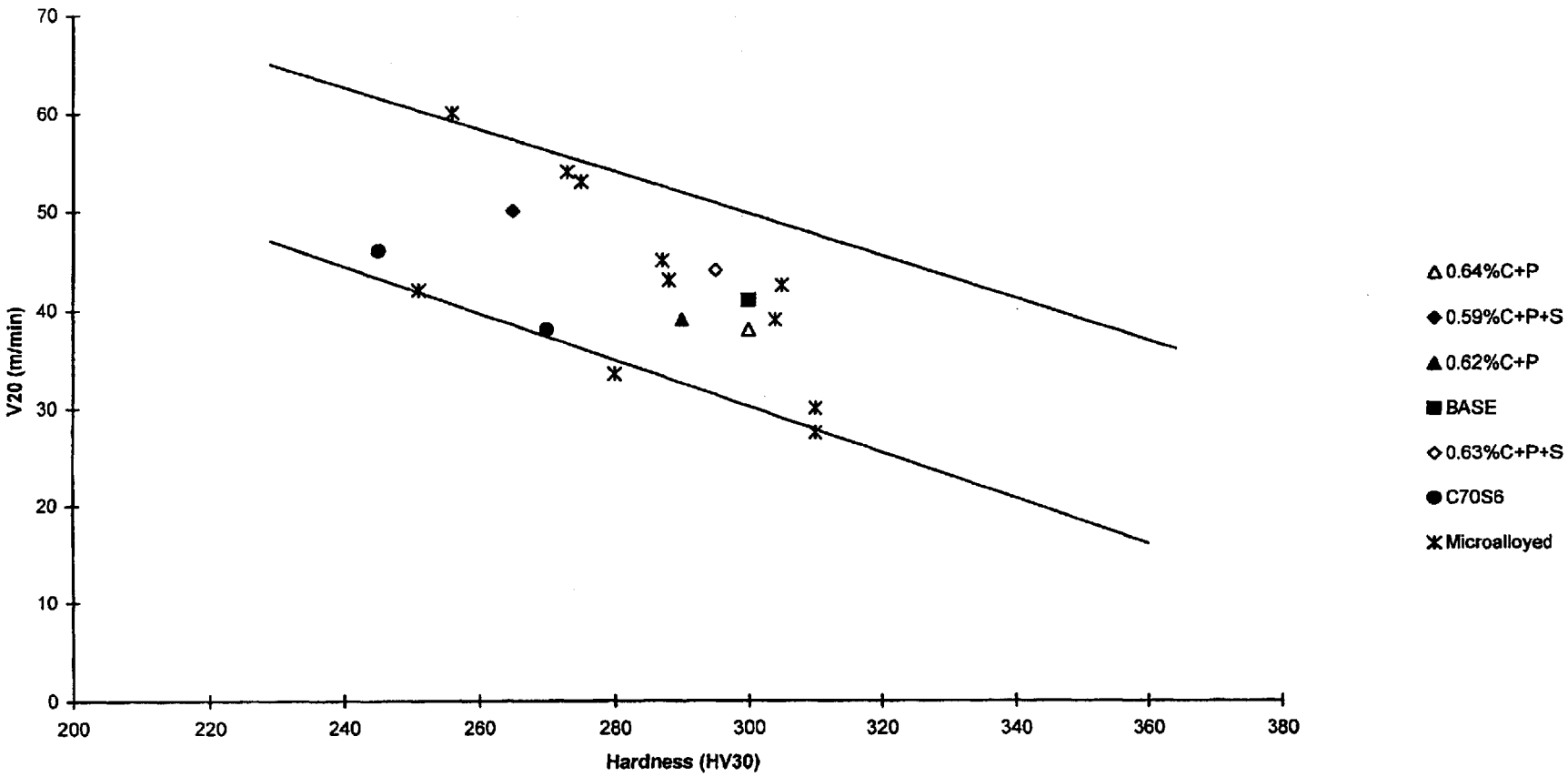
FIG. 4 shows the variation of machinability data including examples of the invention.

The compositions of the two steels with phosphorus and with phosphorus and sulphur additions are very similar, within steelmaking range capability and the two groups have been combined in table 6. It can be seen that both steel types gave out of roundness results similar to those achieved on C70S6 grade. FIG. 4 shows that all the experimental steels had better machinability than C70S6 with the best results being obtained in those with enhanced sulphur levels.

Figure 5:
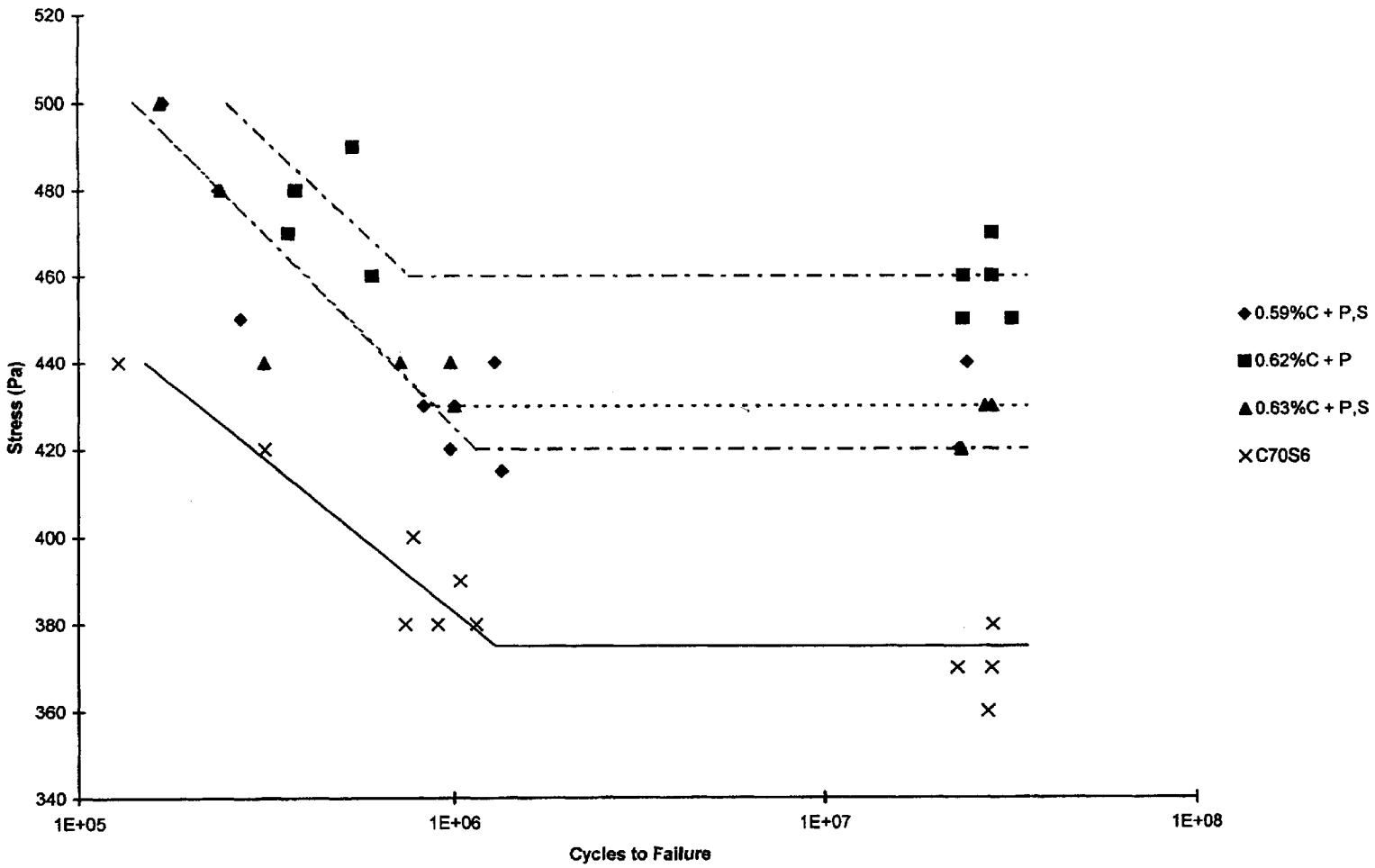
FIG. 5 shows fatigue data for several steels, including C70S6 and steels according to the invention.

FIG. 5 shows fatigue data for several of the samples according to the invention, together with a C70S6 grade for comparison. Those data points at the extreme right-hand edge of the graph which are annotated with upwardly directed arrows correspond to samples which had still not fractured even at the end of the test. It can be seen that all of the inventive steels lie generally above the C70S6 grades, indicating that fatigue properties of the steel according to the present invention are at least as good as those of C70S6.

FIGS. 6*a* and 6*b* are SEM fracture graphs of fracture split connecting rods of C70S6 steel (FIG. 6*a*) and 0.63% carbon steel with phosphorus and sulphur additions (FIG. 6*b*). The micrographs are at ×500 magnification. The C70S6 steel of FIG. 6*a* exhibited an out of roundness after fracturing of 36 μm, whilst the steel according to the present invention of FIG. 6*b* exhibited a comparable out of roundness of 25 μm. It can be seen from FIGS. 6*a* and 6*b* that the fracture surfaces of the two are very similar and exhibit essentially the same structural patterns.

FIGS. 7*a* and 7*b* are optical micrographs of a C70S6 steel (FIG. 7*a*) and a steel according to the present invention (FIG. 7*b*), being 0.63% carbon with phosphorus and sulphur additions. Both micrographs are at ×200 times magnification. Again, it can be seen that the microstructures are very similar and show a generally comparable structure.

Thus, it can be deduced that the present invention allows the production of a steel which shows substantially the same (or at least comparable) mechanical results to the established C70S6 grade, but which exhibits significantly improved machinability compared thereto. By appropriate manipulation of the composition compared to C70S6, therefore, significant production advantages are obtained without necessitating any sacrifice in the performance of the steel in use.

What is claimed is:

1. A fracture splittable steel composition consisting essentially of:

Carbon from 0.60 to 0.65 weight %;

Silicon up to 0.40 weight %;

Manganese from 0.60 to 0.90 weight %;

Phosphorus from 0.030 to 0.070 weight %;

Sulphur from 0.070 to 0.110 weight %;

Chromium up to 0.50 weight %;

Molybdenum up to 0.10 weight %;

Nickel up to 0.5 weight %;

Copper up to 0.50 weight %;

Aluminum up to 0.050 wight %;

Nitrogen up to 0.030 weight %; and

Lead up to 0.4 weight %, and unavoidable impurities, the balance being iron.

2. A steel composition according to claim 1, wherein the elongation of the steel is 19% or less.

3. A steel composition according to claim 1, having a brinell hardness of 200 or greater.

4. A steel composition according to claim 1, having a brinell hardness of 350 or less.

5. A steel composition according to claim 1, having a brinell hardness of 220 to 302.

6. A steel composition according to claim 1, wherein the silicon content of the steel is about 0.10 weight %.

7. A steel composition according to claim 1, wherein the silicon content of the steel is below 0.35%.

8. A steel composition according to claim 1, wherein the silicon content of the steel is between 0.15 and 0.30 weight %.

9. A steel composition according to claim 1, wherein the sulphur content is between 0.080 and 0.100 weight %.

10. A steel composition according to claim 1, wherein the phosphorus content is between 0.035 and 0.050 weight %.

11. A steel composition according to claim 1, wherein the molybdenum content is below 0.05 weight %.

12. A steel composition according to claim 1, wherein the nickel content is below 0.25%.

13. A steel composition according to claim 1, wherein the copper content is below 0.30%.

14. A steel composition according to claim 1, wherein the copper content is below 0.25%.

15. A steel composition according to claim 1, wherein the aluminum content is below 0.025 weight %.

16. A steel composition according to claim 1, wherein the chromium content is between 0.10 to 0.20 weight %.

17. A steel composition according to claim 1, wherein the nitrogen content is below 0.025 weight %.

18. A steel composition according to claim 1, wherein the nitrogen content is below 0.020 weight %.

19. A steel composition according to claim 1, wherein the composition contains vanadium and the vanadium content in amounts sufficient to maintain a yield strength value of over 550 $N/mm^2$ and is above 0.040 weight %.

20. A connection rod for an internal combustion engine made of a steel having a composition according to claim 1.

* * * * *